US005094514A

United States Patent [19]

Grosch

[11] Patent Number: 5,094,514

[45] Date of Patent: Mar. 10, 1992

[54] ARTICLE OF FURNITURE

[75] Inventor: Peter T. Grosch, Abington, Pa.

[73] Assignee: Grolen Incorporated, Conshohocken, Pa.

[21] Appl. No.: 584,527

[22] Filed: Sep. 18, 1990

[51] Int. Cl.[5] ..... A47B 41/06

[52] U.S. Cl. ..... 312/194; 312/233

[58] Field of Search ..... 312/321.5, 233, 194, 312/195; 248/918

[56] References Cited

U.S. PATENT DOCUMENTS

| | | | |
|---|---|---|---|
| 1,181,739 | 5/1916 | Clark | 312/223 |
| 2,893,808 | 7/1959 | Waterman | 312/223 X |
| 4,313,112 | 1/1982 | Foster . | |

*Primary Examiner*—Joseph Falk

*Attorney, Agent, or Firm*—Howson & Howson

[57] ABSTRACT

A computer workstation comprises a substantially horizontal work surface; an opening in the work surface through which a monitor screen can be viewed by an operator from a position above the level of the work surface, and a hinged copy holder movable from a position in which it closes the opening and forms a flush extension of the work surface, to a rearwardly leaning position wherein at least a portion of the copy holder is located above the work surface, and a portion of the copy holder is located substantially below the work surface. A channel is attached to the copy holder for supporting printed matter thereon when the panel is in its rearwardly leaning position. The printed matter is located within a portion of the operator's field of view located substantially immediately above the field in which the monitor screen is viewed.

17 Claims, 3 Drawing Sheets 10
12
14
16
20c
40
66
22
4
54
52
44
38
42
64
14
20a
34
24
20b
4

ARTICLE OF FURNITURE

BRIEF SUMMARY OF THE INVENTION

This invention relates to furniture, and more particularly to an article of furniture intended for use as a computer workstation, wherein an operator manipulates a keyboard, mouse, digitizer board, joystick or other controller, and views a display of alphanumeric data or graphics on a video monitor.

In conventional computer workstations, a video monitor is located in front of the operator approximately at eye level. In many applications, such as word processing or computer-aided design (CAD), it is frequently necessary for the operator to refer to printed matter, or drawings, i.e. "copy", while entering information on a keyboard. In the conventional workstation, the copy is positioned alongside the monitor, either to the right or to the left. The copy may lie flat on a horizontal worksurface, or may be supported on a copy stand which lies on the worksurface. In either case, the copy takes up valuable worksurface space, which is otherwise usable for other purposes. One proposed solution to the copy positioning problem is described in U.S. Pat. No. 4,893,775, issued Jan. 16, 1990 to Roy J. Long. In Long, a copy holder is positioned directly behind the keyboard, and the monitor is raised so that it is visible above the copy holder. The copy holder is hinged, and can be folded downward to cover the keyboard when not in use.

Another form of computer workstation designed to provide more usable working surface is described in U.S. Pat. No. 4,869,564, issued Sept. 26, 1989 to John N. Lechman and in U.S. Pat. No. 4,775,009, issued Jul. 5, 1988 to Macy J. Price. In the workstations of Lechman and Price, the monitor is located underneath the plane of the worksurface and visible through a transparent panel of glass or glare-resistant plastics material which is substantially co-planar with the worksurface. Since the video monitor is located below the plane of the worksurface, more usable working surface is available. However, in each case, it is necessary to place copy to the right or to the left of the transparent panel through which the monitor is viewed, or to use a special copy holder, which can be positioned to the right or to the left of the transparent panel, or to the rear thereof. Another disadvantage of workstations using transparent panels is that the panels can be easily smudged when used as working surfaces, and must be cleaned frequently. Also, if the transparent panels are composed of glare-resistant plastics, they can be easily scratched when used as working surfaces.

The principal object of the present invention is to provide a computer workstation which provides a conveniently usable and durable working surface when the video monitor is not in use, and which places the copy in a convenient field of view directly above the field in which the operator views the monitor screen, so that the operator can easily shift his or her eyes from the copy to the monitor and vice-versa with a minimum amount of effort.

A further object of the invention is to provide an article of furniture which is readily and easily convertible from a computer workstation to a working surface having a large usable area.

Still a further object of the invention is to provide a workstation having a monitor located below the level of the working surface and having a copy holder which is in close proximity to the monitor screen.

These objects are addressed by an article of furniture in accordance with the invention which comprises means for supporting a video monitor with its screen facing upward at an oblique angle, and a hinged copy holder movable from a horizontal position in which it obstructs viewing of the screen while providing a horizontal working surface to a rearwardly leaning position wherein the monitor screen can be viewed, and means attached to said copy holder for supporting printed matter thereon when the copy holder is in its rearwardly leaning position, whereby the printed matter is located within the operator's field of view substantially immediately above the field in which the monitor screen is viewed.

In a preferred embodiment of the invention, the article of furniture comprises means providing a substantially horizontal work surface having front and rear edges; supporting means, located underneath said work surface, for supporting a video monitor below said work surface with the screen of the monitor disposed at an angle permitting it to be viewed through an opening in said work surface by an operator located in front of said front edge of the work surface; wherein said work surface-providing means has an opening through which said monitor screen can be viewed from a position above the level of said work surface, a panel having edges and being of a size substantially conforming to said opening, said panel being positionable to close said opening and having opposite faces, one of said faces forming an additional work surface when the panel is positioned to close said opening, means for supporting said panel when said panel is positioned to close said opening, said supporting means including hinge means supporting said panel for rotating movement about a horizontal axis whereby said panel can be rotated from its position closing said opening, through a vertical position, to a rearwardly leaning position wherein the opposite face of the panel is located above the level of the top of said monitor screen; stop means for retaining said panel in said rearwardly leaning position; and means attached to said panel for supporting printed matter on said opposite face thereof when the panel is in said rearwardly leaning position, whereby the printed matter is located within the operator's field of view located substantially immediately above the field in which the monitor screen is viewed.

In the preferred embodiment of the invention, the means providing a substantially horizontal work surface comprises a stationary, substantially horizontal table top having top and bottom surfaces. The opening is an opening in the table top. The panel has first and second opposite edges, the first edge being a rear edge when the panel is positioned to close the opening. The hinge means is preferably located so that the horizontal axis about which the panel rotates is spaced forward of the first edge of the panel when the panel is positioned to close the opening, whereby said rear edge of the panel is located below the bottom surface of said table top when the panel is in its rearwardly leaning position. The top face of the panel is preferably flush with the portions of the work surface immediately adjacent to the opening when the panel is positioned to close the opening. The hinge means are preferably located entirely below the level of said work surface, whereby the additional work surface provided by the upper face of the panel is substantially smoothly continuous with the work surface provided by the work surface providing means. The means for supporting printed matter on said opposite face of said panel preferably comprises channel means positioned along an edge of the panel.

Further objects, advantages and details of the invention will be apparent from the following detailed description when read in conjunction with the drawings.

DETAILED DESCRIPTION

Figure 1:
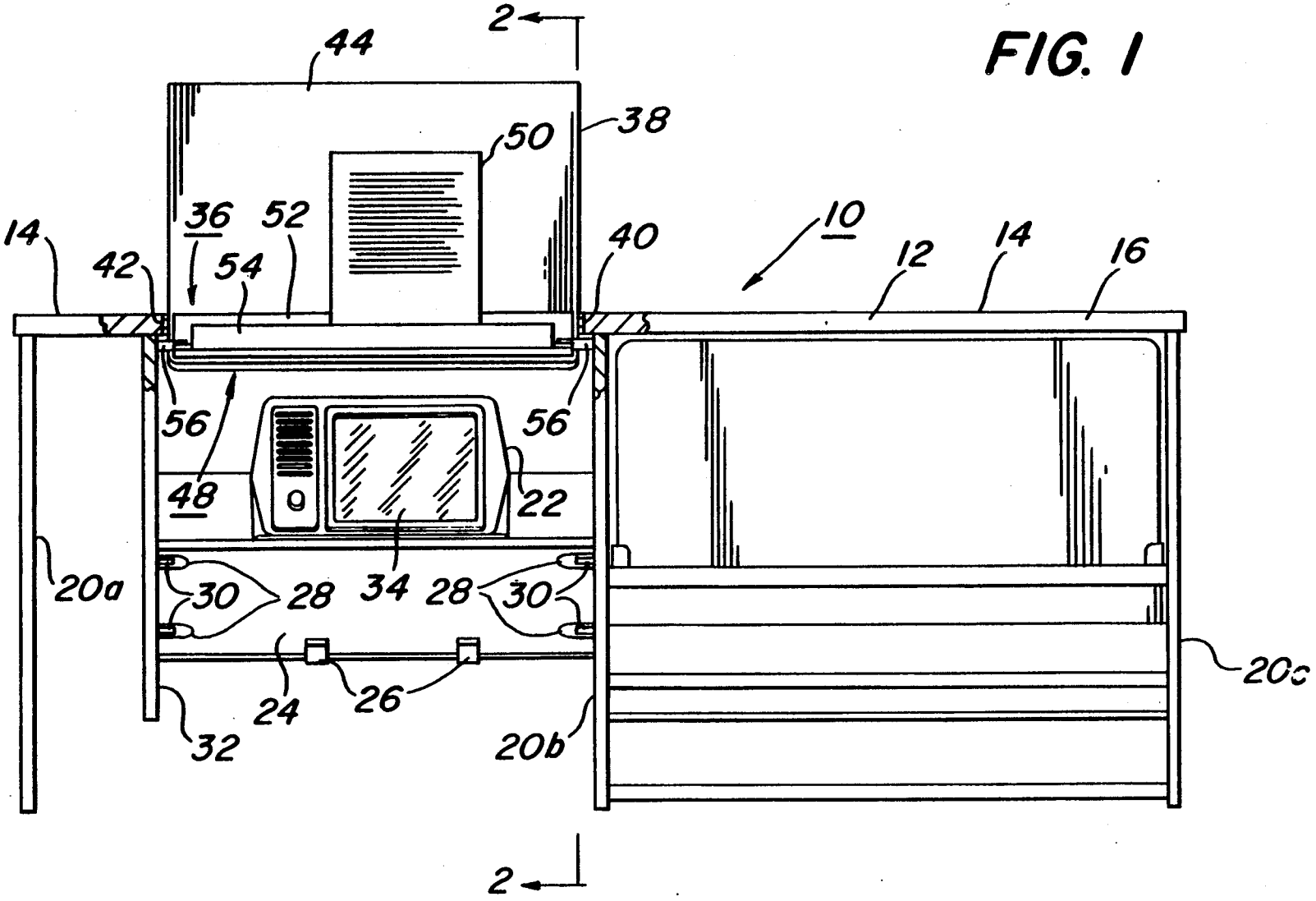
FIG. 1 is a front elevational view of a computer workstation in accordance with the invention, showing the hinged panel in its rearwardly leaning position.
Figure 2:
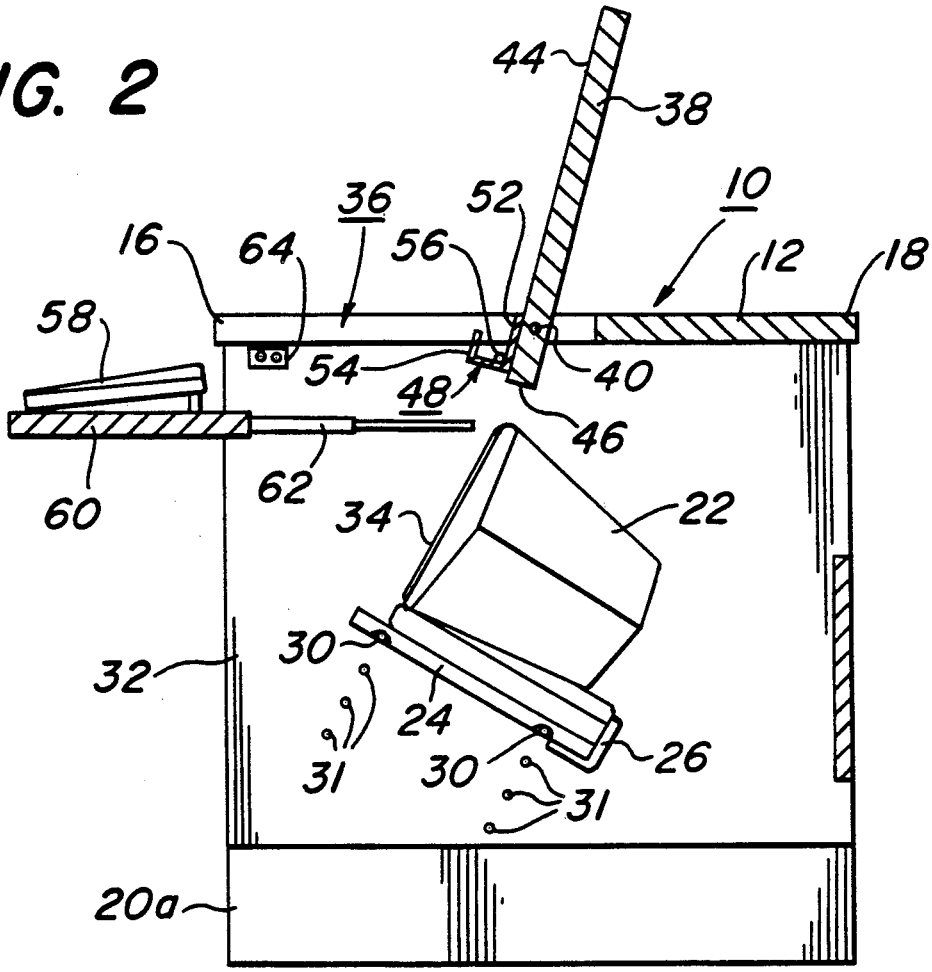
FIG. 2 is a vertical section taken on plane 2—2 of FIG. 1.

FIGS. 1 and 2 show an article of furniture, generally indicated by reference numeral 10. The article of furniture is generally in the form of a desk, having a table top 12 of wood, melamine-covered compressed particle board, molded solid plastics material or other suitable material, providing a substantially horizontal work surface 14 having a front edge 16 and a rear edge 18. The table top 12 is supported at an appropriate distance from the floor, e.g. from 29 to 30 inches, by pedestals 20*a*, 20*b* and 20*c*. The section of the desk between pedestals 20*b* and 20*c* can be used for any desired purpose. In the desk shown, this section is provided with shelving for a printer and its paper supply.

The section of the desk between pedestals 20*a* and 20*b* is used to accommodate a video monitor 22. The monitor is supported on a shelf 24, the upper surface of which slopes downward and rearward, and which has a pair of brackets 26 at its rear edge to prevent the monitor from sliding off the shelf. Shelf 24 is supported at any desired one of a plurality of available positions by pins 30, which extend into grooves 28 in the bottom of shelf 24. Pins 30 are removably received in sockets in panel 32 and in pedestal 20*b*. Eight such sockets are provided in panel 32 and eight corresponding sockets are provided in pedestal 20*b*. Six such sockets are seen in FIG. 2 at 31.

As shown in FIGS. 1 and 2, shelf 24 is supported on the pins 30 located in the uppermost sockets. The screen 34 of monitor 22 slopes upward and rearward.

Monitor screen 34 is visible through an opening 36 provided in work surface 14. As will be apparent from FIGS. 1 and 2, portions of work surface 14 on both sides of opening 36 are connected by a portion of the work surface located behind the opening. The opening extends to the front edge 16 of the work surface.

A panel 38, which is preferably of same material and thickness as table top 12, is hinged on pins 40 and 42 for rotation about a horizontal axis parallel to front and rear edges 16 and 18. Face 44 of panel 38 is shown in a rearwardly inclined condition. Its lower edge 46 is located below the level of the lower face of table top 12, well below the level of work surface 14. This places the printed matter in close proximity to the upper edge of monitor screen 34 so that the printed matter is in a field of view immediately above the field of view in which the monitor screen is located.

A metal channel 48 is secured to face 44 of panel 38 near lower edge 46. This metal channel serves to hold printed matter 50. The channel comprises a horizontally elongated plate 52 which is secured against panel face 44, and a somewhat shorter flange 54, which is parallel to, but spaced, from panel face 44. Panel 38 is prevented from rearward rotation beyond the rearwardly inclined position in which it is shown by the engagement of plate 52 with stop pins 56 which extend outwardly from depending panel 32 and pedestal 20*b*.

A keyboard 58, shown in FIG. 2 but omitted from FIG. 1 for clarity, rests on a sliding shelf 60, which slides horizontally on a guide 62 mounted on depending panel 32 and on a similar guide (not shown) on pedestal 20*b*. The keyboard shelf can be moved from the extended position shown in FIG. 2 to a stowed position as shown in FIG. 4.

Figure 4:
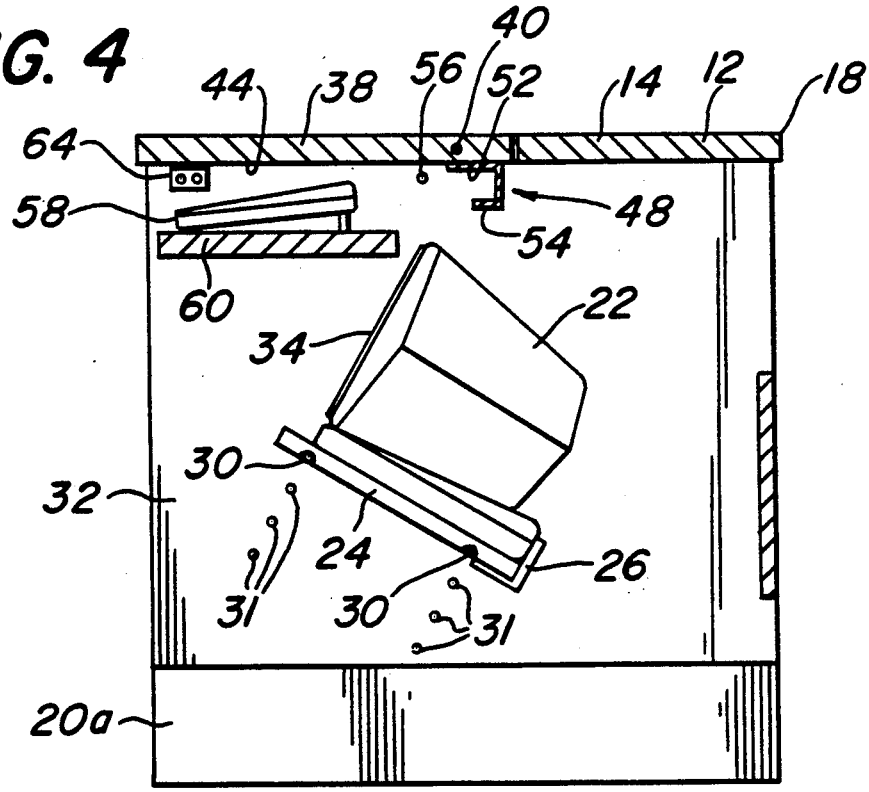
FIG. 4 is a vertical section taken on plane 4—4 of FIG. 3.
Figure 3:
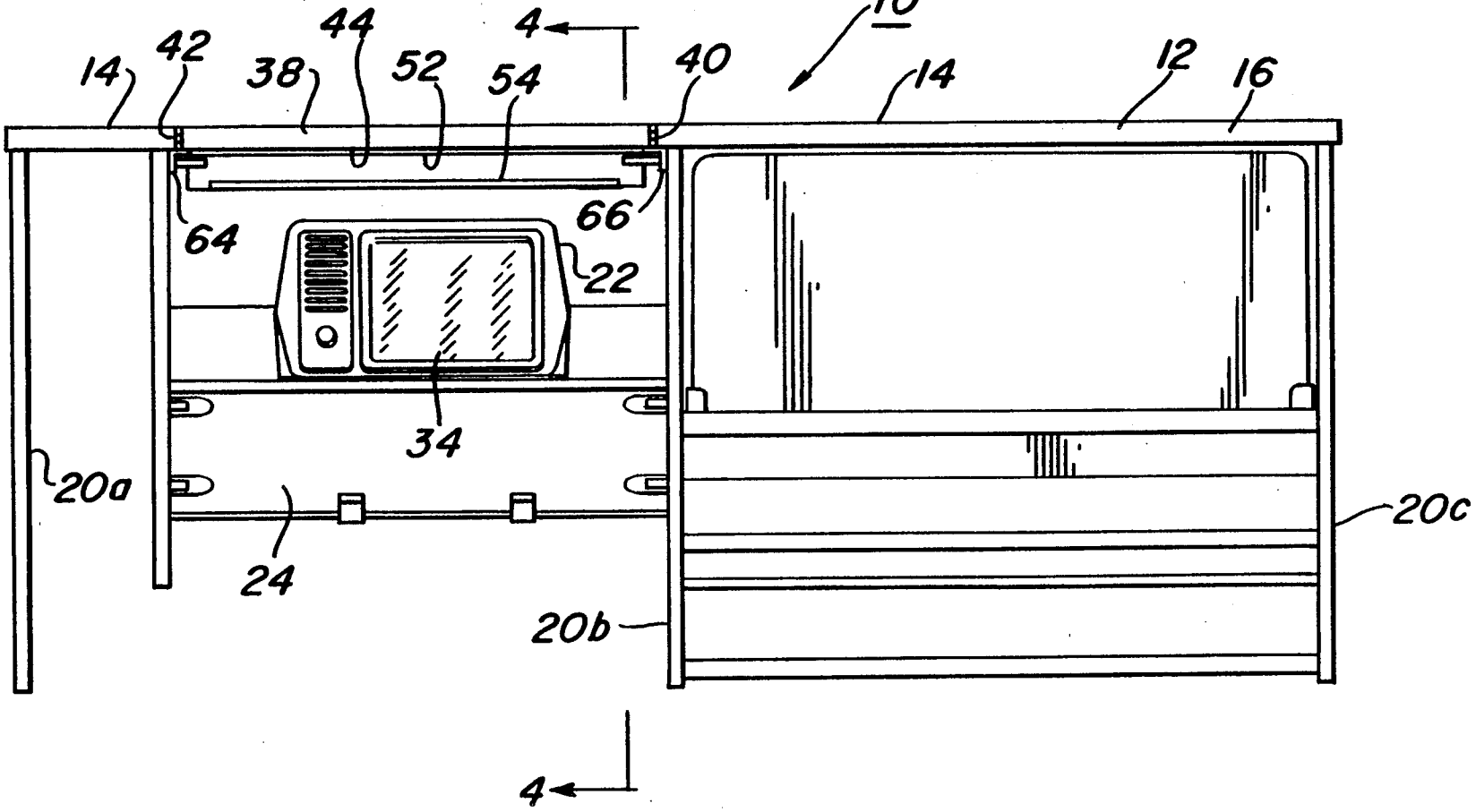
FIG. 3 is a front elevational view of the same computer workstation, showing the hinged panel in its horizontal position.

An L-shaped support 64, seen in FIGS. 2 and 4, is secured to the right face of depending panel 32, near front edge 16 of the work surface, with the horizontal upper surface of the support flush with the lower surface of table top 12. A similar support 66 is secured to the left face of pedestal 20*b* as shown in FIG. 3. These two supports are engaged by face 44 of panel 38 when the panel is rotated to its horizontal position as shown in FIGS. 3 and 4. The upper surface 66 of panel 38 is flush with working surface 14 and, since the panel conforms in shape to opening 36, it forms a continuation of the working surface when the panel is in its horizontal or closed position. It also protects the keyboard when the keyboard is in its stowed position as shown in FIG. 4.

Positioning the hinge pins so that a portion of panel 38 extends below the level of work surface 14 not only allows the copy to be in close proximity to the video monitor, but also permits the panel to be held in its rearwardly leaning position by stop pins 56 located underneath the level of work surface 14. Hinge pins 40 and 42, stop pins 56 and supports 64 and 66 are all located underneath the level of work surface 14. Consequently, a large, unobstructed work surface is provided when panel 38 is in its horizontal position.

The workstation can be used as a conventional desk when configured as in FIGS. 3 and 4. By simply clearing the top of panel 38, flipping it up to its rearwardly inclined condition, and pulling forward on keyboard shelf 60, the user can convert the desk almost instantly to a computer workstation having a conveniently located copy holder positioned in a field of view immediately above the field in which the monitor screen is located. The user has usable workspace on both sides of the opening through which the monitor is viewed.

Numerous modifications can be made to the apparatus specifically described, and the invention can be embodied in a large number of alternative configurations. For example, assuming that the outer pedestals 20*a* and 20*c* provide adequate support, pedestal 20*b* can be eliminated in favor of a depending panel similar to panel 32.

While the embodiment shown is in the form of a convertible desk having printer shelving located to one side of the monitor, many of the advantages of the invention can be realized in a narrower workstation having shelving for a printer located above the horizontal working surface and vertically aligned with the monitor. This version of the workstation has less horizontal working surface than the workstation shown in the drawings, but has the advantage that it takes up less floor area. Since the copy holder can be rotated into a horizontal position in which it closes the opening through which the monitor is viewed, even the narrow workstation in accordance with the invention has much more usable horizontal working area than conventional narrow width workstations.

The opening in the table top of the workstation need not extend all the way to the front edge, nor is it necessary to have horizontal working surfaces on both sides of the opening or to the rear thereof. For example, the rotating panel which serves as a copy holder can extend all the way to the rear edge of the table top, and can extend to the right edge or to the left edge.

While stop pins 56 have certain advantages, alternative means, such as conventional hinged lid stays, can be used in place of the stop pins. Likewise alternative means can be used in place of L-shaped supports 64 to hold the copy holder in its horizontal position. A movable ruler can be provided on panel face 44 to enable the operator to keep his or her place in the copy being transcribed and to provide additional support for the copy material. Various other modifications can be made to the apparatus described without departing from the scope of the invention as defined in the following claims.

I claim:

1. An article of furniture comprising means for supporting a video monitor with its screen facing at an oblique angle both upward and in a forward direction, and a copy holder in the form of a panel having first and second parallel, opposite surfaces and first and second opposite edges extending transverse to said forward direction, said copy holder having a hinge adjacent to its first edge with the hinge axis parallel to said first edge, and said copy holder being movable, about said hinge, from a horizontal position in which it obstructs viewing of said screen, by an operator whose eyes are positioned upward and forward of said screen at said oblique angle, while said first surface provides a horizontal, upwardly facing, working surface with said second edge located forward of said first edge, to a rearwardly leaning position wherein said monitor screen can be viewed by said operator and said second surface faces upward and forward and provides a backing for printed matter supported thereon with said second edge located above and to the rear of said first edge, and means attached to said copy holder for supporting printed matter on said second surface when the copy holder is in said rearwardly leaning position, whereby the printed matter is located within the operator's field of view substantially immediately above the field in which the monitor screen is viewed.

2. An article of furniture according to claim 1 in which said means for supporting printed matter on said copy holder comprises channel means positioned along said first edge of said copy holder.

3. An article of furniture comprising means for supporting a video monitor with its screen facing upward at an oblique angle, and a hinged copy holder movable from a horizontal position in which it obstructs viewing of said screen while providing a horizontal working surface to a rearwardly leaning position wherein said monitor screen can be viewed, and means attached to said copy holder for supporting printed matter thereon when the copy holder is in said rearwardly leaning position, whereby the printed matter is located within the operator's field of view substantially immediately above the field in which the monitor screen is viewed, in which said copy holder comprises a panel having first and second opposite faces and an edge, hinge means for supporting said panel for rotation about a horizontal hinge axis located near said edge and extending substantially parallel to said edge, and channel means positioned along said edge of said panel, said channel means comprising an elongated plate secured to one of said faces of the panel near said edge, at least a portion of said plate being nearer to said edge than said hinge axis is near said edge, and stop means engageable by said elongated plate for limiting rearward leaning movement of said panel.

4. An article of furniture according to claim 3 in which said channel includes an elongated copy-retaining flange connected to said plate and spaced therefrom, said flange being shorter than said plate in order to clear said stop means when said panel moves from its horizontal position to its rearwardly leaning position.

5. An article of furniture comprising a substantially horizontal work surface; an opening in said work surface through which a monitor screen can be viewed by an operator from a position above the level of said work surface; and a hinged copy holder movable from a position in which it closes said opening to a rearwardly leaning position wherein at least a portion of said copy holder is located above said work surface and a monitor screen can be viewed through said opening; and means attached to said copy holder for supporting printed matter thereon when the copy holder is in said rearwardly leaning position, whereby the printed matter is located within the operator's field of view substantially immediately above the field in which the monitor screen is viewed.

6. An article of furniture according to claim 5 in which, when said hinged copy holder is in said rearwardly leaning position, at least a portion of said copy holder is located below said work surface.

7. An article of furniture according to claim 5 in which, when said hinged copy holder is in said rearwardly leaning position, at least a portion of said copy holder is located below said work surface, and including stop means, located below the level of said work surface and engageable with said portion of the copy holder, for preventing rearward leaning movement of said copy holder beyond said rearwardly leaning position.

8. An article of furniture according to claim 5 in which said substantially horizontal work surface is provided by a stationary, substantially horizontal table top having top and bottom surfaces, in which said opening is an opening in said table top, in which, when said hinged copy holder is in said rearwardly leaning position, at least a portion of said copy holder is located below the level of the underside of said table top.

9. An article of furniture according to claim 5 in which one face of the copy holder is flush with the portions of the work surface immediately adjacent to said opening when the copy holder is positioned to close said opening, whereby said one face of said copy holder is substantially smoothly continuous with the work surface provided by said work surface providing means.

10. An article of furniture according to claim 5 in which said means for supporting printed matter on said copy holder comprises channel means positioned along an edge of said copy holder.

11. An article of furniture comprising: means providing a substantially horizontal work surface having front and rear edges; supporting means, located underneath said work surface, for supporting a video monitor below said work surface with the screen of the monitor disposed at an angle permitting it to be viewed through an opening in said work surface by an operator located in front of said front edge of the work surface; wherein said work surface-providing means has an opening through which said monitor screen can be viewed from a position above the level of said work surface, a panel having edges and being of a size substantially conforming to said opening, said panel being positionable to close said opening and having opposite faces, one of said faces forming an additional work surface when the panel is positioned to close said opening, means for supporting said panel when said panel is positioned to close said opening, said supporting means including hinge means supporting said panel for rotating movement about a horizontal axis whereby said panel can be rotated from its position closing said opening, through a vertical position, to a rearwardly leaning position wherein the opposite face of the panel is located above the level of the top of said monitor screen; stop means for retaining said panel in said rearwardly leaning position; and means attached to said panel for supporting printed matter on said opposite face thereof when the panel is in said rearwardly leaning position, whereby the printed matter is located within the operator's field of view located substantially immediately above the field in which the monitor screen is viewed.

12. An article of furniture according to claim 11 in which said panel has first and second opposite edges, said first edge being a rear edge when the panel is positioned to close said opening, and in which the hinge means is located so that the horizontal axis about which the panel rotates is spaced forward of said first edge when the panel is positioned to close said opening, whereby said rear edge of the panel is located below the level of said work surface when the panel is in said rearwardly leaning position.

13. An article of furniture according to claim 11 in which said means providing a substantially horizontal work surface comprises a stationary, substantially horizontal table top having top and bottom surfaces, in which said opening is an opening in said table top, in which said panel has first and second opposite edges, said first edge being a rear edge when the panel is positioned to close said opening, and in which the hinge means is located so that the horizontal axis about which the panel rotates is spaced forward of said first edge when the panel is positioned to close said opening, whereby said rear edge of the panel is located below the bottom surface of said table top when the panel is in said rearwardly leaning position.

14. An article of furniture according to claim 11 in which said one of said faces of the panel is flush with the portions of the work surface immediately adjacent to said opening when the panel is positioned to close said opening, in which said hinge means are located entirely below the level of said work surface, whereby said additional work surface provided by said one of said faces of said panel is substantially smoothly continuous with the work surface provided by said work surface providing means.

15. An article of furniture according to claim 11 in which said means for supporting printed matter on said opposite face of said panel comprises channel means positioned along an edge of said panel.

16. An article of furniture according to claim 11 in which said means providing a substantially horizontal work surface comprises a stationary, substantially horizontal table top having top and bottom surfaces; in which said opening is an opening in said table top; in which said panel has first and second opposite edges, said first edge being a rear edge when the panel is positioned to close said opening; in which the hinge means is located so that the horizontal axis about which the panel rotates is spaced forward of said first edge when the panel is positioned to close said opening, whereby said rear edge of the panel is located below the bottom surface of said table top when the panel is in said rearwardly leaning position; in which said one of said faces of the panel is flush with the portions of the work surface immediately adjacent to said opening when the panel is positioned to close said opening, in which said hinge means are located entirely below the level of said work surface, whereby said additional work surface provided by said one of said faces of said panel is substantially smoothly continuous with the work surface provided by said work surface providing means; and in which said means for supporting printed matter on said opposite face of said panel comprises channel means positioned along an edge of said panel.

17. An article of furniture according to claim 11 including stop means for limiting rotation of said panel beyond said rearwardly leaning position, in which said means providing a substantially horizontal work surface comprises a stationary, substantially horizontal table top having top and bottom surfaces; in which said opening is an opening in said table top; in which said panel has first and second opposite edges, said first edge being a rear edge when the panel is positioned to close said opening; in which the hinge means is located so that the horizontal axis about which the panel rotates is spaced forward of said first edge when the panel is positioned to close said opening, whereby said rear edge of the panel is located below the bottom surface of said table top when the panel is in said rearwardly leaning position; in which said one of said faces of the panel is flush with the portions of the work surface immediately adjacent to said opening when the panel is positioned to close said opening; and in which said hinge means and said stop means are located entirely below the level of said work surface, whereby said additional work surface provided by said one of said faces of said panel is substantially smoothly continuous with the work surface provided by said work surface providing means.

* * * * *